US007424908B2

(12) United States Patent
Blomgren

(10) Patent No.: US 7,424,908 B2
(45) Date of Patent: Sep. 16, 2008

(54) PLATE PACK, A PLATE HEAT EXCHANGER, AND A PLATE MODULE

(75) Inventor: Ralf Blomgren, Skanör (SE)

(73) Assignee: Alfa Laval Corporate AB

( * ) Notice: Subject to any disclaimer, the term of this patent is extended or adjusted under 35 U.S.C. 154(b) by 646 days.

(21) Appl. No.: 10/540,804

(22) PCT Filed: Feb. 2, 2004

(86) PCT No.: PCT/SE2004/000138

§ 371 (c)(1),
(2), (4) Date: Jun. 27, 2005

(87) PCT Pub. No.: WO2004/072570

PCT Pub. Date: Aug. 26, 2004

(65) Prior Publication Data

US 2006/0048927 A1 Mar. 9, 2006

(30) Foreign Application Priority Data

Feb. 11, 2003 (SE) ..... 0300364

(51) Int. Cl.
*F28F 3/08* (2006.01)

(52) U.S. Cl. ..... 165/167; 165/DIG. 364

(58) Field of Classification Search ..... 165/166, 165/167

See application file for complete search history.

(56) References Cited

U.S. PATENT DOCUMENTS 4,063,591 A * 12/1977 Usher ..... 165/167
4,660,633 A * 4/1987 Fischer ..... 165/167
4,987,955 A * 1/1991 Bergqvist et al. ..... 165/167
5,327,958 A * 7/1994 Machata et al. ..... 165/167
5,443,115 A * 8/1995 Pedersen et al. ..... 165/70
5,522,462 A * 6/1996 Kumar et al. ..... 165/166
5,924,484 A * 7/1999 Andersson et al. ..... 165/167
5,971,065 A 10/1999 Bertilson et al.
6,131,648 A * 10/2000 Rasmussen ..... 165/145
6,478,081 B1 * 11/2002 Shaw ..... 165/167
2002/0050347 A1 * 5/2002 Hainley et al. ..... 165/167

FOREIGN PATENT DOCUMENTS

| | | | |
|---|---|---|---|
| DE | 3 152 944 | | 5/1987 |
| DK | 151915 | | 1/1988 |
| GB | 2 080 930 | | 2/1982 |
| JP | 09089487 A | * | 4/1997 |
| JP | 2001056189 A | * | 2/2001 |
| WO | WO 8300736 A1 | * | 3/1983 |

* cited by examiner

*Primary Examiner*—Allen J Flanigan
(74) *Attorney, Agent, or Firm*—Fish & Richardson P.C.

(57) ABSTRACT

The invention relates to a plate package and a plate heat exchanger. The plate package includes plate modules with two heat exchanger plates (3), which extend at at least an intermediate plane, and upper and lower planes. The heat exchanger plates are permanently connected to each other and form an inner first space therebetween. The plate modules are stacked to each other and form a second space therebetween. Each heat exchanger plate includes two portholes (13) which permit communication with the first space. Each porthole is defined by a port edge (31) and surrounded by a ring groove (32) for a gasket member. The ring groove is formed by a bottom (33) at the level of the intermediate plane, an inner lateral limitation (34) and an outer lateral limitation (35). The outer lateral limitation forms a surface extending without any interruptions. The inner lateral limitation includes interruptions.

25 Claims, 5 Drawing Sheets

PLATE PACK, A PLATE HEAT EXCHANGER, AND A PLATE MODULE

THE BACKGROUND OF THE INVENTION AND PRIOR ART

The present invention refers to a plate package for a plate heat exchanger, which includes at least two plate modules each including at least two heat exchanger plates, which each has a primary side and a secondary side and is compression-moulded to extend at at least an intermediate plane, an upper plane and a lower plane with respect to the primary side, which planes are substantially parallel to each other. Said two heat exchanger plates are permanently connected to each other in such a way that the heat exchanger plates form an inner first space between the secondary sides of the heat exchanger plates. Said plate modules are mounted adjacent to each other and form a second space between each other. Each heat exchanger plate includes a first porthole and a second porthole, which are arranged to permit communication with the first space. Each first and second porthole is defined by a port edge and surrounded by ring groove, which is adapted to receive a gasket member and provided at the primary side at a distance from the port edge. The ring groove is formed by a bottom, which is substantially positioned at the level of said intermediate plane, an inner lateral limitation that extends upwardly from the bottom towards the port edge and around the bottom, and an outer lateral limitation that extends upwardly from the bottom away from the port edge and around the bottom. The invention also refers to a plate heat exchanger with such a plate package, and a plate module for a plate package according to the initial portion of claim 16.

Such plate packages are frequently formed by plate modules with two heat exchanger plates which are welded to each other, and are frequently used in applications where there is a first aggressive medium, or a very high pressure, and a second medium which does not attack the gasket members. Sometimes the second medium may also lead to a risk for fouling in such a way that there must be a possibility to open the plate package for cleaning of the second spaces between the pairs of welded heat exchanger plates.

An important advantage with a plate package with such pairs of welded plates is that the welds, which replace the gaskets in every second plate interspace around the heat exchanging surface of the heat exchanger plates, reduce the need of gasket replacement and enhances the security. All gaskets in the plate package can however not be replaced by weld joints if the plate package is to be openable for access to the heat exchanging surfaces in the second spaces for mechanical cleaning. The second space between the pairs of welded plates must be sealed by means of gaskets and this is also true for the first and second portholes mentioned above. The ring gasket which is provided around each of these portholes puts a limit to the performance of the first space, but since the ring gasket has a relatively small volume of material it may be manufactured in a material of high quality without increasing the costs for the heat exchanger too much.

The ring groove on the heat exchanger plates, which is used today in plate packages of the kind initially defined, has the disadvantage that they do not in a reliable manner maintain the gasket in a proper position in the ring groove even if ring gaskets of high quality are used. The outer lateral surface of the ring groove is intermittent, which means that the ring gasket can partly be pushed out of the ring groove since the atmospheric pressure prevails outside the outer lateral surface and since the pressure in the porthole is substantially higher than the atmospheric pressure. This means that the first aggressive medium may leak out of the plate package. Such a risk for leakage is not acceptable, especially when the plate package is used in applications with cooling agents such as freon or ammonium hydrate. At high temperatures, the most gasket materials soften and then the pressure may press the gasket out through the opening so that a significant leakage arises, a so-called gasket blowing.

GB-A-2 080 930 discloses a plate package for a plate heat exchanger. The plate package includes a plurality of plate modules, which each includes two heat exchanger plates welded to each other and forming a first inner space between the heat exchanger plates. The plate modules are stacked on each other and form a second inner space between each other. Each heat exchanger plate includes a first porthole and a second porthole, which are arranged to permit communication with the first inner space. Each such porthole is defined by a port edge and surrounded by a ring groove, which receives a ring gasket and is provided at a distance from the port edge. The ring groove is formed by a bottom, a first continuous lateral surface extending upwardly from the bottom away from the port edge and around the bottom, and a second continuous lateral surface extending upwardly from the bottom towards the port edge and around the bottom.

DK-B-151 915 discloses another plate package for a plate heat exchanger, which includes a plurality of plate modules each enclosing a first inner space. The plate modules are stacked on each other and form a second inner space between each other. Each plate module includes a first porthole and a second porthole, which are arranged to permit communication with the first inner space. Each such porthole is defined by a port edge and surrounded by a ring groove, which receives a ring gasket and is provided at a distance from the port edge. The ring groove is formed by a bottom, a first continuous lateral surface extending upwardly from the bottom away from the port edge and around the bottom, a second continuous lateral surface extending upwardly from the bottom towards the port edge and around the bottom.

SUMMARY OF THE INVENTION

The object of the present invention is to overcome the problem mentioned above and to reduce the risk for leakage in the plate package of the kind initially defined. In particular, it is aimed at an improved design of the area around the portholes mentioned above in order to reduce the risk for leakage, and to ensure a high pressure performance for the welded channel.

This object is achieved by the initially defined plate package, which is characterised in that the outer lateral limitation forms a surface which extends without any interruptions substantially continuously around the whole bottom and that the inner lateral limitation has a discontinuous extension around the bottom and includes interruptions along this extension. Since the outer lateral limitation thus is a continuous surface, a substantially completely closed outer sidewall is formed by the two outer lateral limitations of the two heat exchanger plates, which with their respective primary sides abuts each other in the plate package. The ring gasket is thus in an efficient manner prevented by this outer sidewall from being pressed out of the ring groove. At the same time, the discontinuous or intermittent inner lateral limitation permits the ring gasket to expand at the defined interruptions of the inner lateral surface.

According to an embodiment of the invention, each heat exchanger plate includes an inner border area at each porthole, wherein the inner border area extends around the port edge between the port edge and the inner lateral limitation and wherein the inner border area includes a plurality of lower portions which form said interruptions and extend from the bottom and through the inner lateral surface. Thanks to these interruptions at the lower portions a possibility is thus created for the ring gasket to creep out in the direction towards the porthole, which is advantageous since the ring gasket frequently expands in contact with media. It is also advantageous during the construction and design of the ring gasket. Since excess of material may be pressed out at the interruptions, the ring gasket may be made with a certain excess of material for compensating for measure deviations of both the gasket groove and the ring gasket. This is not possible with a closed groove. If the ring groove has an undersize and the ring gasket an oversize, the ring gasket is compressed significantly for certain rubber qualities and crossing damages may arise. Also the plates may be damaged. Permanent deformations may arise in the groove bottom and the surrounding structure.

According to a further embodiment of the invention, said lower portions are positioned substantially at the level of the lower plane. The heat exchanger plates in said plate module may then be arranged in such a way that the heat exchanger plates at the secondary side abut each other at said lower portions. In such a way the lower portions will form support points between the two heat exchanger plates in the plate module, which are essential for the strength of the plate package around the portholes.

According to a further embodiment of the invention, the inner border area beside said lower portions includes a plurality of upper portions which are located at a level above said intermediate plane in such a way that the inner border area includes lower portions and upper portions in an alternating order. In such a way, a ring of alternating high and low portions is formed between the port edge and the ring groove, wherein the inner lateral surface will be alternatively open and closed along its extension around the bottom. Advantageously, said upper portions may be located at a level which lies just below the upper plane. In such a way, a small gap is formed between the upper portions of the two plates abutting each other. This gap ensures that these plates may be pressed against each other so that the ring gasket is compressed sufficiently for forming a reliable sealing.

According to a further embodiment of the invention, each heat exchanger plate includes an outer border area which extends around the outer lateral surface immediately outside the outer lateral limitation, wherein the outer border area has an upper ring-shaped surface which is located at the level of the upper plane.

According to a further embodiment of the invention, the bottom of the ring groove in a cross section has a somewhat concave shape seen from the primary side. Such a non-plane shape of the bottom means that the bottom will be cold-worked in connection with the compression-moulding of the plate and that a certain increase of the yield limit is achieved. This shape of the bottom is also favourable with regard to the force absorption of the gasket load. The material will absorb the load both as bending stresses and membrane stresses, in contrast to a plane bottom which merely absorbs the load as bending stresses, which means that the deflection of the ring groove is reduced. This is advantageous since it permits use of relatively thin ring gaskets. Advantageously, the bottom at said cross-section may then have a central, substantially plane portion which extends around the ring grove, an inner inclined portion, which extends around the ring groove towards the inner lateral limitation, and an outer inclined portion, which extends around the ring groove towards the outer lateral surface.

According to a further embodiment of the invention, the gasket member includes a ring gasket having an elongated cross-sectional shape. It is also possible to let the gasket member include two ring gaskets, which each has a substantially circular cross-sectional shape in a non-compressed state. Such ring gaskets of the O-ring type are inexpensive and easily available. O-rings may be of various materials. The inner one may be manufactured of a material with resistance against the aggressive medium and the outer one may have a good resistance against oxidation. A closed outer surface is required if O-rings are to be used.

According to a further embodiment of the invention, the gasket member includes an attachment member for attachment of the gasket member in the ring groove. Said attachment member may extend inwardly towards the porthole and engage the port edge. Preferably, the attachment members extend around the port edge and into the interspace formed between two upper portions of two plates in the plate module.

The object is also achieved by a plate heat exchanger including a plate package according to any one of the above defined embodiments of the invention.

The object is also achieved by the plate module initially defined, which includes the characterising features of claim 16. Advantageous embodiments of the plate module are defined in the depending claims 17-25.

BRIEF DESCRIPTION OF THE DRAWINGS

The present invention is now to be explained more closely through a description of various embodiments and with reference to the drawings attached.

FIG. 9 discloses schematically a view along the line I-I in FIG. 6 of a section through two pairs of plates arranged adjacent to each other with a ring gasket there between.

FIG. 10 discloses schematically a view along the line II-II in FIG. 6 of a section through two pairs of plates arranged adjacent to each other with a ting gasket there between.

FIG. 11 discloses schematically a view along the line III-III in FIG. 6 of a section through two pairs of plates arranged adjacent to each other with a ring gasket there between.

DETAILED DESCRIPTION OF VARIOUS EMBODIMENTS OF THE INVENTION

Figure 1:
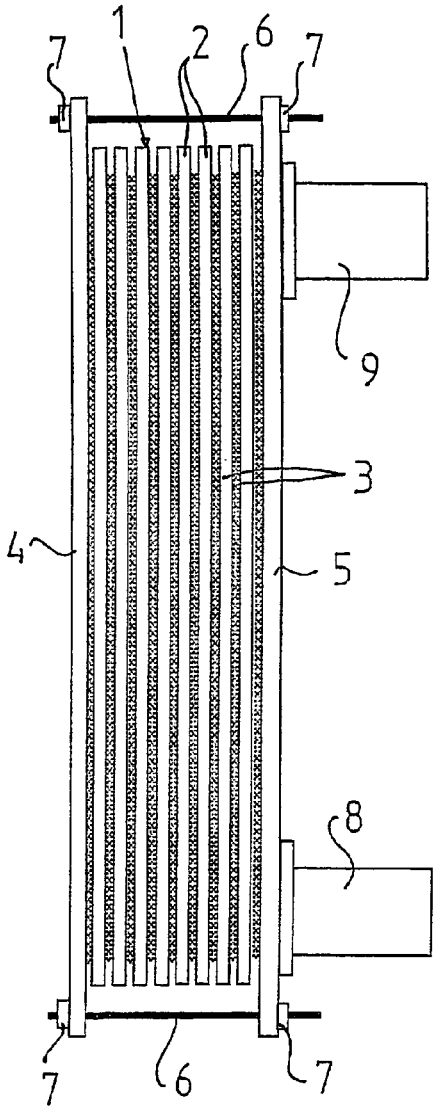
FIG. 1 discloses schematically a sideview of a plate heat exchanger with a plate package.
Figure 2:
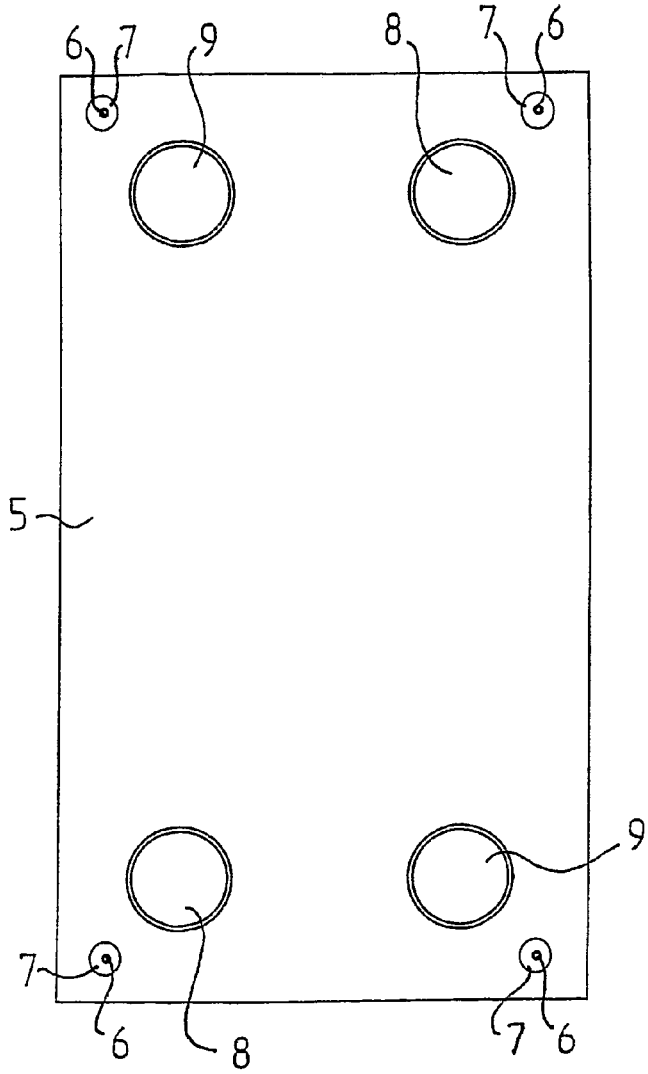
FIG. 2 discloses schematically a view of the right end plate of the plate heat exchanger in FIG. 1.

FIGS. 1 and 2 discloses a plate heat exchanger including a plate package 1 with a number of plate modules 2, which each includes a number of heat exchanger plates 3 arranged adjacent to each other. Each such plate module 2 includes in the embodiments disclosed two heat exchanger plates 3, but it is to be noted that the plate modules 2 also may include more than two heat exchanger plates 3 which preferably are permanently connected to each other. The plate package 1 is arranged between two end plates 4 and 5. The end plates 4 and 5 are pressed against the plate package 1 and each other by means of tightening bolts 6 extending through the end plates 4 and 5. The tightening bolts 6 include threads and the plate package 1 may thus be compressed by threading nuts 7 onto the tightening bolts 6 in a manner known per se. In the embodiments disclosed, four tightening bolts 6 are indicated. It is to be noted that the number of tightening bolts 6 may vary and be different in different applications. The plate heat exchanger also includes two inlet members 8 and two outlet members 9. The inlet and outlet members 8, 9 extend through one of the endplates 5 and the plate package 1.

Figure 7:
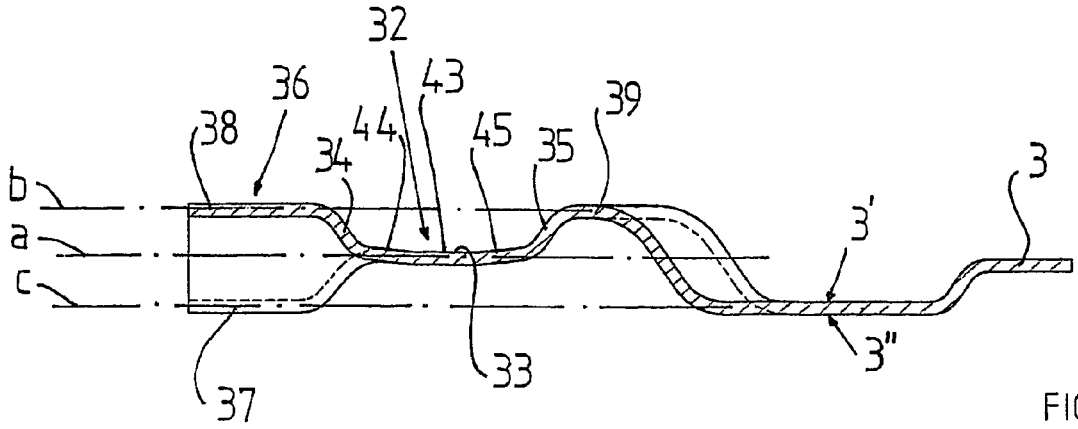
FIG. 7 discloses schematically a view along the line I-I in FIG. 6 of a section through a non-welded plate.
Figure 8:
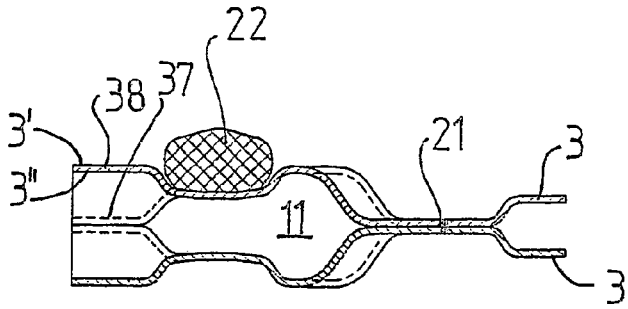
FIG. 8 discloses schematically a view along the line I-I in FIG. 6 of a section through a pair of two plates welded to each other.
Figure 9:
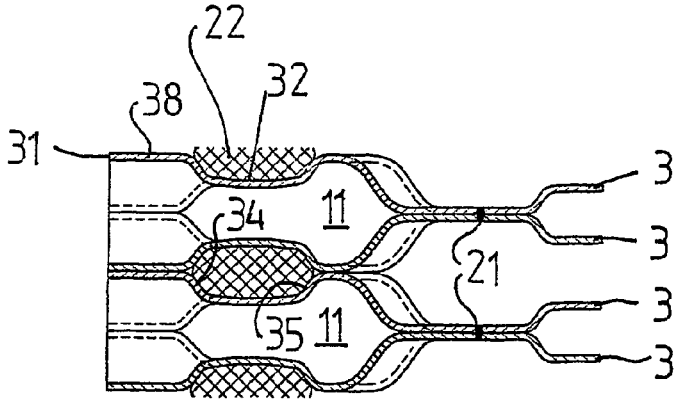
Figure 10:
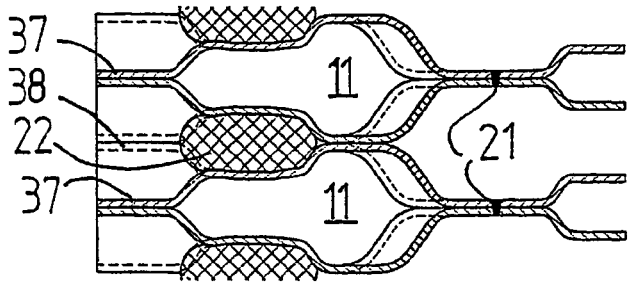
Figure 11:
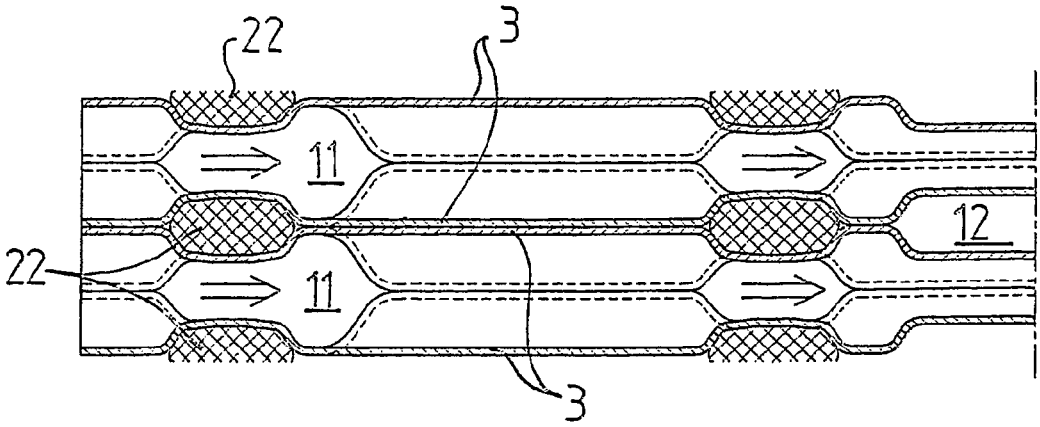

Each heat exchanger plate 3 has a primary side 3' and a secondary side 3", see FIG. 7, and is compression-moulded to extend at at least one intermediate plane a, an upper plane b and a lower plane c with regard to the primary side 3', which planes a, b, c, are substantially parallel to each other. The intermediate plane a may for instance, but not necessarily, be located centrally between the lower plane c and the upper plane b. The two heat exchanger plates 3 in each plate module 2 in the embodiments disclosed are connected to each other in such a way that the heat exchanger plates 3 form an inner first space 11 between the secondary sides 3" of the heat exchanger plates 3. The plate modules are stacked onto each other and form a second space 12 between each other, which is indicated with dotted lines in FIG. 11, wherein the primary sides 3" of the two heat exchanger plates 3 are facing each other and the second space 12.

Each heat exchanger plate 3 includes a first porthole 13 and a second porthole 14, which are arranged to permit communication with the first space 11. Each heat exchanger plate 3 also includes a third porthole 15 and a fourth porthole 16, which are arranged to permit communication with the second space 12. The first and third portholes 13 and 15 extend to the inlet members 8. The second and fourth portholes 14 and 16 extend to the outlet members 9.

A first medium may thus be introduced through a first inlet member 8 and a first portholes 13, through the first inner spaces 11 and out through the second portholes 14 and a first outlet member 9. A second medium may be introduced through a second inlet member 8 and the third portholes 15, through the second inner spaces 12 and out through the fourth portholes 16 and a second outlet member 9. The two media are conveyed in a counter flow in relation to each other in the embodiments disclosed, but may also be conveyed in parallel in relation to each other.

Figure 3:
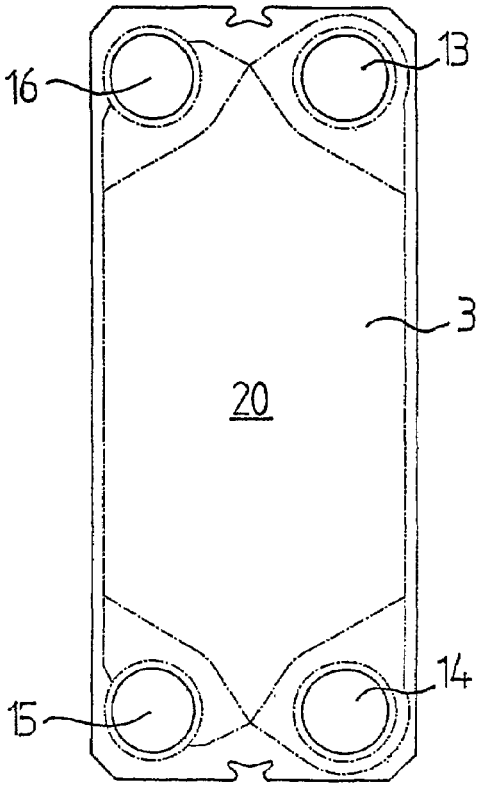
FIG. 3 discloses schematically a plan view of a heat exchanger plate for the plate package in FIG. 1.
Figure 4:
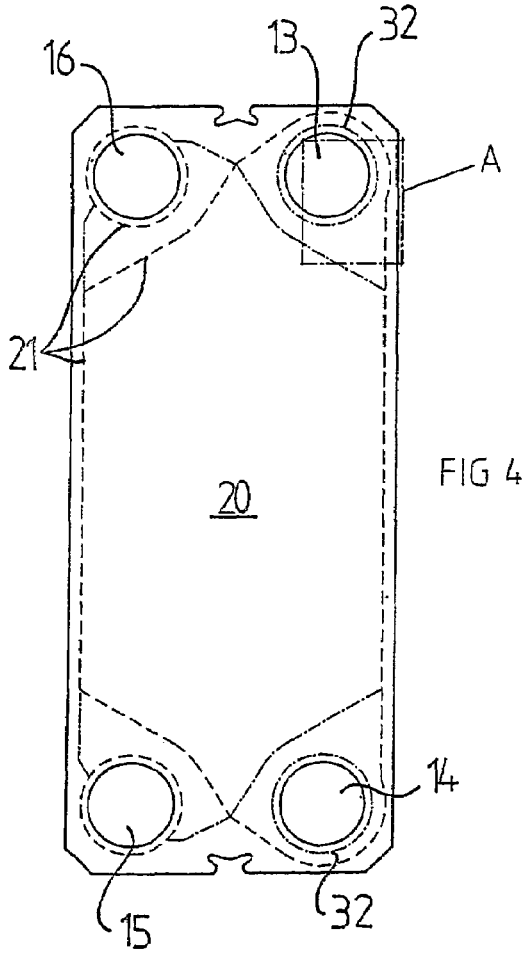
FIG. 4 discloses schematically a plan view of the heat exchanger plate in FIG. 3 welded to another heat exchanger plate.
Figure 5:
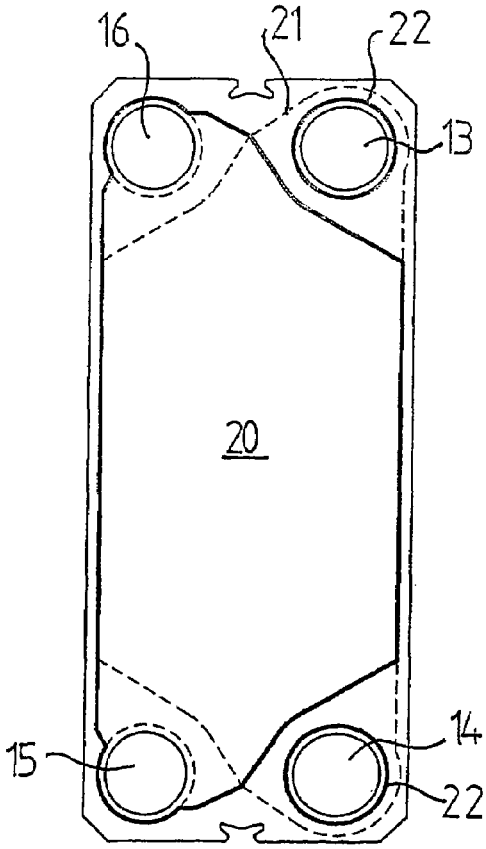
FIG. 5 discloses schematically a plan view of the heat exchanger plate in FIG. 3 welded to another heat exchanger plate and provided with gasket members.

Each heat exchanger plate 3 is preferably manufactured of a metal sheet, for instance stainless steel or titanium, and includes a substantially central heat exchanging surface 20, see FIGS. 3-5. The heat exchanging surface 20 may in a manner known per se be provided with a corrugation of ridges and valleys (not disclosed) obtained through said compression-moulding of the metal sheet. Also substantially completely plane heat exchanging surfaces 20 may be used within the scope of this invention. The two heat exchanger plates 3 in each plate module 2 are permanently connected to each other by means of welding, brazing or gluing. FIGS. 4 and 5 disclose a plate module 2 where the heat exchanger plates 3 are connected to each other by means of a weld joint 21 extending around the heat exchanging surface 20 and the first and second portholes 13, 14. Weld joints 21 also extend around the third and fourth portholes 15, 16.

Between the plate modules 2, gasket members are provided for sealing the second spaces 12. The gasket members include at least one ring gasket 22 around each of the first and second portholes 13, 14, see FIG. 5, and a main gasket 23 extending around the heat exchanging surface 20 and the third and fourth portholes 15, 16.

Figure 6:
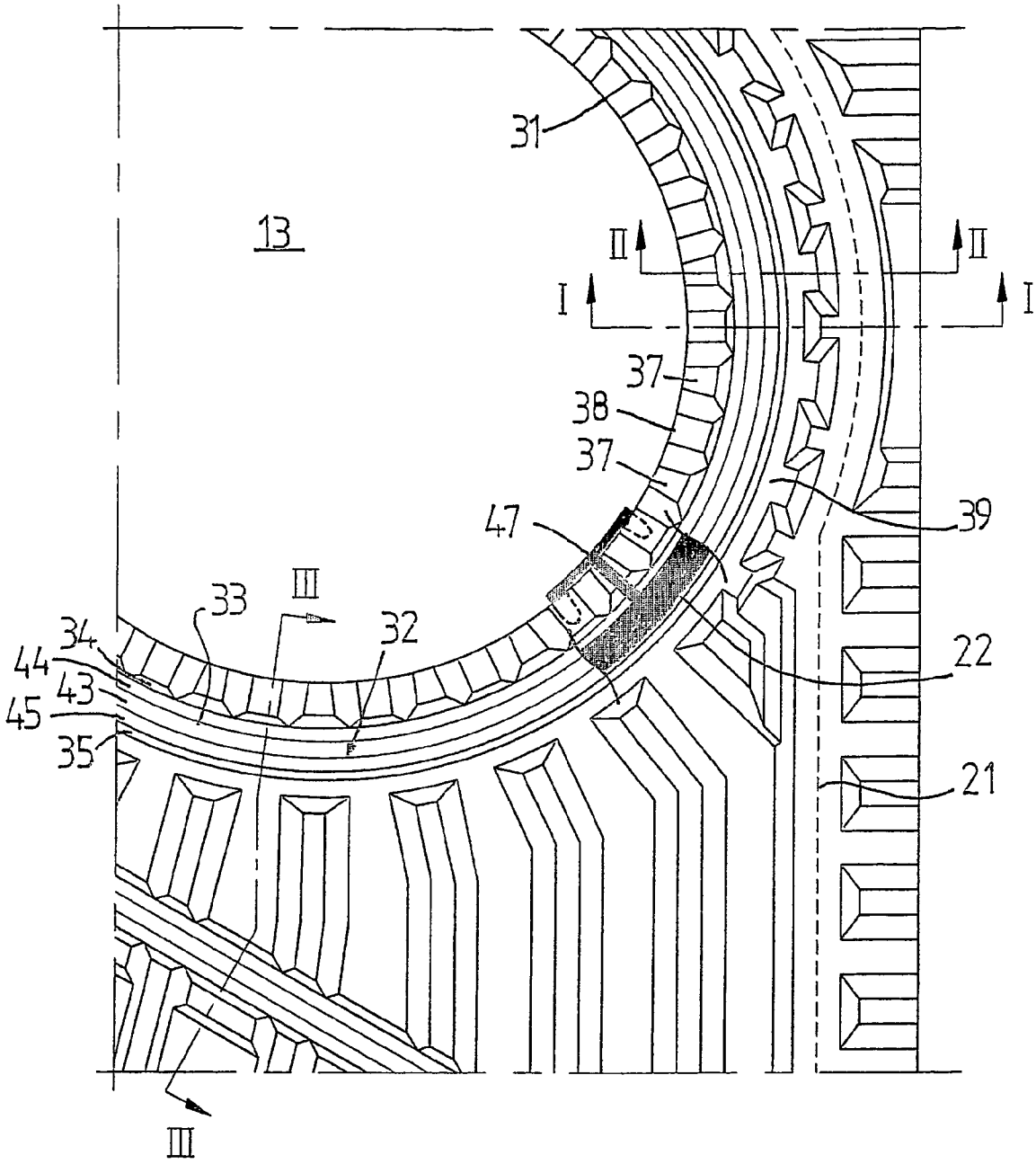
FIG. 6 discloses schematically an enlarged plan view of the area A in FIG. 4.

Each of the portholes 13-16 is defined by a port edge 31, see FIG. 6. Each of the first and second portholes 13, 14 is surrounded by a ring groove 32, which is arranged to receive a gasket member, for instance the ring gasket 22 mentioned above. The ring groove 32 is provided on the primary side 3' at a determined distance from the port edge 31. The ring groove 32 is formed by a bottom 33, an inner lateral limitation 34 and an outer lateral limitation 35. The bottom is substantially positioned at the level of said intermediate plane a. The inner lateral limitation 34 extends upwardly from the bottom 33 in a direction towards the port edge 31 and around the bottom 33. The outer lateral limitation 35 extends upwardly from the bottom 35 away from the port edge 31 and around the bottom 33. The outer lateral limitation 35 forms a substantially whole surface and thus extends substantially continuously around the whole bottom 33. The inner lateral limitation 34 is however discontinuous or intermittent, and includes interruptions along its extension around the bottom 33. Between the ring groove 32 and the port edge 31 of the first and second port holes 13, 14, there is an inner border area 36. The inner border area 36 extends around the port edge 31 between the port edge 31 and the inner lateral limitation 34.

The inner border area 36 includes a plurality of lower portions 37, which extend from the bottom 31 and through the inner lateral limitation 34 and form said interruptions. The lower portions 37 are positioned substantially at the level of the lower plane c and extend to the port edge 31. Furthermore, the inner border area 36 includes beside the lower portions 37 a plurality of upper portions 38. The upper portions 38 are located at a level above said intermediate plane a in such a way that the inner border area 36 includes lower portions 37 and upper portions 38 in an alternating order. The upper portions 38 are located at a level lying just beneath the upper plane b. The two heat exchanger plates 3 in each plate module 2 are thus arranged in such a way that the heat exchanger plates 3 on the secondary side 3" abut each other at the lower portions 37. The inner lateral limitation 34 thus includes a plurality of interruptions or lower portions 37. Preferably, the number of interruptions or lower portions 37 is relatively big and equal to the number of upper portions 38. The lower and upper portions 37, 38 may also advantageously have substantially the same length, i. e. an equal division.

Thanks to the alternating lower and upper portions 37, 38, the inner lateral limitation 34 obtains the discontinuous or intermittent shape mentioned above, and the lower and upper portions 37, 38 form a corrugation of ridges and valleys, which extends around the first and second portholes 13, 14. The ridges and valleys extend in a substantially radial direction with regard to a centre point of their respective porthole 13, 14.

Outside the ring groove 38 of the first and second portholes 13, 14, an outer border area 39 is provided, which extends around the outer lateral limitation 35 immediately outside the outer lateral limitation 35. The outer border area 39 has an upper ring-shaped surface which is located at the level of the upper plane b. When the plate modules are stacked against each other, the outer border areas 39 of the outer heat exchanger plates 3 of two adjacent plate modules 2 will abut each other. In such a way, the outer side surfaces of these two plates form a substantially whole, unbroken wall preventing the ring gasket 22 from being pressed outwardly from the ring groove 32.

The bottom 33 of the ring groove 32 may in a cross-section have a somewhat concave shape seen from the primary side 3', see FIG. 7. The concave shape may in said cross-section be softly curved or, as appears from FIG. 13, include a central, substantially plane portion 43, which extends around the ring groove 32, an inner inclined portion 44, which extends around the ring groove 32 towards the inner lateral limitation 34, and an outer inclined portion 45, which extends around the ring groove 32 towards the outer lateral limitation 35.

Figure 12:
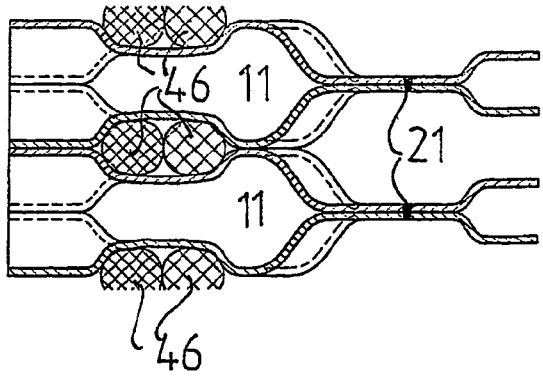
FIG. 12 discloses a view corresponding to the one in FIG. 9 but with two ring gaskets.

In the embodiment disclosed in FIGS. 8-11, the gasket member includes a ring gasket 22 with an elongated cross-sectional shape, which corresponds to the cross-sectional shape of the space formed by the two ring grooves 32 which are facing each other in the plate package 2. The gasket member for the ring groove 32 may however also, as an alternative, include two ring gaskets 46, which each has a substantially circular cross-sectional shape in a non-compressed state, see FIG. 12. The gasket member may also include one or several attachment members 47 for attachment of the gasket member in the ring groove 32. The attachment member 47 has a T-like shape and extends inwardly to the respective porthole 13, 14 and engages the port edge 31, see FIG. 6 that discloses a part of the ring gasket 22 with such an attachment member 47. The ring gasket 22 may also be attached in another way to the heat exchanger plate 3, for instance by gluing.

The invention is not limited to the embodiments disclosed but may be varied and modified within the scoop of the following claims.

What is claimed is:

1. A plate package for a plate heat exchanger comprising:

at least two plate modules each including at least two heat exchanger plates, each of which has a primary side and a secondary side and is compression-molded to extend at at least an intermediate plane, an upper plane, and a lower plane with respect to the primary side, which planes are substantially parallel to each other, wherein the two heat exchanger plates are permanently connected to each other such that the heat exchanger plates form an inner first space between the secondary sides of the heat exchanger plates, wherein the plate modules are mounted adjacent to each other and form a second space between each other, wherein each heat exchanger plate includes a first porthole and a second porthole, which are arranged to permit communication with the first space, wherein each of the first and second portholes is defined by a port edge and surrounded by a ring groove, which is adapted to receive a gasket member and provided at the primary side at a distance from the port edge, wherein the ring groove is formed by a bottom, which is substantially positioned at the level of the intermediate plane, an inner lateral limitation that extends upwardly from the bottom in a direction towards the port edge and around the bottom and an outer lateral limitation that extends upwardly from the bottom away from the port edge and around the bottom, and wherein the outer lateral limitation forms a surface which extends without any interruptions substantially continuously around the whole bottom and the inner lateral limitation has a discontinuous extension around the bottom and includes interruptions along the extension.

2. A plate package according to claim 1, wherein each heat exchanger plate includes an inner border area at each of the first and second portholes, wherein the inner border area extends around the port edge between the inner port edge and the inner lateral limitation and wherein the inner border area includes a plurality of lower portions which form the interruptions and extend from the bottom and through the inner lateral limitation.

3. A plate package according to claim 2, wherein the lower portions are positioned substantially at the level of the lower plane.

4. A plate package according to claim 3, wherein the heat exchanger plates in the plate modules are arranged such that the heat exchanger plates at the secondary side abut each other at the lower portions.

5. A plate package according to claim 2, wherein the lower portions extend up to the port edge.

6. A plate package according to claim 2, wherein the inner border area beside the lower portions includes a plurality of upper portions which are located at a level above the intermediate plane such that the inner border area includes lower portions and upper portions in an alternating order.

7. A plate package according to claim 6, wherein the upper portions are located at a level which lies just below the upper plane.

8. A plate package according to claim 1, wherein each heat exchanger plate includes an outer border area which extends around the outer lateral limitation immediately outside the outer lateral limitation, wherein the outer border area has an upper ring-shaped surface which is located at the level of the upper plane.

9. A plate package according to claim 1, wherein the bottom of the ring groove in a cross-section has a somewhat concave shape seen from the primary side.

10. A plate package according to claim 9, wherein the bottom at the cross-section has a central, substantially planar portion which extends around the ring groove, an inner inclined portion, which extends around the ring groove towards the inner lateral limitation, and an outer inclined portion, which extends around the ring groove towards the outer lateral limitation.

11. A plate package according to claim 1, wherein the gasket member includes a ring gasket having an elongated cross-sectional shape.

12. A plate package according to claim 1, wherein the gasket member includes two ring gaskets, each of which has a substantially circular cross-sectional shape in a non-compressed state.

13. A plate package according to claim 1, wherein the gasket member includes an attachment member for attachment of the gasket member in the ring groove.

14. A plate package according to claim 13, wherein the attachment member extends inwardly towards the porthole and engages the port edge.

15. A plate heat exchanger comprising a plate package according to claim 1.

16. A plate module for a plate package for a plate heat exchanger, the plate module comprising:

at least two heat exchanger plates, each of which has a primary side and a secondary side and is compression-molded to extend at at least an intermediate plane, an upper plane, and a lower plane with respect to the primary side, which planes are substantially parallel to each other, wherein the two heat exchanger plates are permanently connected to each other such that the heat exchanger plates form an inner first space between the secondary sides of the heat exchanger plates, wherein each heat exchanger plate includes a first porthole and a second porthole, which are arranged to permit communication with the first space, wherein each of the first and second portholes is defined by a port edge and surrounded by a ring groove, which is adapted to receive a gasket member and provided at the primary side at a distance from the port edge, wherein the ring groove is formed by a bottom, which is substantially positioned at the level of the intermediate plane, an inner lateral limitation that extends upwardly from the bottom in a direction towards the port edge and around the bottom and an outer lateral limitation that extends upwardly from the bottom away from the port edge and around the bottom, and wherein the outer lateral limitation forms a surface which extends without any interruptions substantially continuously around the whole bottom and the inner lateral limitation has a discontinuous extension around the bottom and includes interruptions along the extension.

17. A plate module according to claim 16, wherein the plate module is adapted to be mounted adjacent to a similar plate module in a plate package for forming a second space between the plate modules.

18. A plate module according to claim 16, wherein each heat exchanger plate includes an inner border area at each of the first and second portholes, wherein the inner border area extends around the port edge between the port edge and the inner lateral limitation and wherein the inner border area includes a plurality of lower portions which form the interruptions and extend from the bottom through the inner lateral limitation.

19. A plate module according to claim 18, wherein the lower portions are positioned substantially at the level of the lower plane.

20. A plate module according to claim 18, wherein the lower portions extend up to the port edge.

21. A plate module according to claim 18, wherein the inner border area beside the lower portions includes a plurality of upper portions which are positioned at a level above the intermediate plane such that the inner border area includes lower portions and upper portions in an alternating order.

22. A plate module according to claim 21, wherein the upper portions are located at a level which lies just below the upper plane.

23. A plate module according to claim 16, wherein each heat exchanger plate includes an outer border area which extends around the outer lateral limitation immediately outside the outer lateral limitation, wherein the outer border area has an upper ring-shaped surface located at the level of the upper plane.

24. A plate module according to claim 16, wherein the bottom of the ring groove in a cross-section has a somewhat concave shape seen from the primary side.

25. A plate module according to claim 24, wherein the bottom at the cross-section has a central substantially planar portion which extends around the ring groove, an inner inclined portion, which extends around the ring groove to the inner lateral limitation, and an outer inclined portion, which extends around the ring groove to the outer lateral limitation.

* * * * *